US005244196A

United States Patent [19]

Walter et al.

[11] Patent Number: 5,244,196

[45] Date of Patent: Sep. 14, 1993

[54] PIVOTABLE TRANSFER CONVEYOR

[75] Inventors: Bernd H. Walter, Naples, Fla.; James Kennish, Chester, Conn.

[73] Assignee: GBR Systems Corporation, Naples, Fla.

[21] Appl. No.: 837,118

[22] Filed: Feb. 19, 1992

[51] Int. Cl.[5] ..... B42C 1/00; B65G 35/00

[52] U.S. Cl. ..... 270/46; 270/32; 270/45; 270/59; 198/626.5

[58] Field of Search ..... 198/592, 626.1, 626.5; 270/32, 45, 46, 51, 58, 59, 4

[56] References Cited

U.S. PATENT DOCUMENTS

| | | | |
|---|---|---|---|
| 209,639 | 11/1878 | Ainsworth | 198/592 |
| 318,143 | 5/1885 | Scott | 270/45 |
| 2,663,564 | 12/1953 | Meffert | 270/59 |
| 4,361,393 | 11/1982 | Noto | 270/53 X |
| 4,696,464 | 9/1987 | Gammerler | 270/51 X |
| 4,697,944 | 10/1987 | Peebles et al. | 198/592 X |
| 5,013,201 | 5/1991 | Grathoff et al. | 198/626.1 X |

FOREIGN PATENT DOCUMENTS

| | | | |
|---|---|---|---|
| 523667 | 2/1956 | Belgium | 198/626.1 |
| 661408 | 7/1938 | Fed. Rep. of Germany | 198/165 |
| 57590 | 9/1967 | Fed. Rep. of Germany | 270/45 |

*Primary Examiner*—Edward K. Look
*Assistant Examiner*—John Ryznic
*Attorney, Agent, or Firm*—Stoll, Miskin, Previto & Hoffman

[57] ABSTRACT

A transfer conveyor for conveying an article. The conveyor has an article-receiving end and an article-releasing end. An article is moved from the article-receiving end to the article-releasing end by a plurality of moving belts. The article is placed between the belts. A mechanism supplies an article to the article-receiving end and an article-removing mechanism is provided to remove the article from the article-releasing end.

8 Claims, 4 Drawing Sheets

PIVOTABLE TRANSFER CONVEYOR

BACKGROUND

The present invention relates to a transfer conveyor and more particularly to a position controlled transfer conveyor for transferring stacks of paper from a stacking station to another station.

Heretofore, transfer mechanisms for stacks of paper have used chain belts or other similar mechanisms to transport a stack of paper from a folding mechanism to a removal mechanism, such as a gripper arm which removes the stack. The stack is transferred in some other mechanism to have another operation performed on it, such as shipping. These earlier transfer conveyors did not always accurately present the package to the removal gripper arm. In addition, auxiliary power was often necessary in order to give the transfer conveyor sufficient power to move the package along. During the movement of the package on the transfer conveyor it was often necessary to use additional hold down devices to prevent the package from moving. With such devices it was not easy to remove a package if it became necessary. In addition, indexing chains used in existing transfer mechanisms pose a number of hazards which sometimes placed the operator in some danger of being injured. Moreover, some transfer conveyors do not provide secure repeatable positioning of the package as it leaves the folding mechanism so that the packages are sometimes not precisely indexed. Furthermore, some existing transfer mechanisms have fitted dividers between stations so that the number of indexed stations cannot be varied to accommodate packages of different sizes. If packages of different sizes are being processed, conveyor adjustments are necessary. In many instances, since there is no mechanism for securing the types of packages being transported, very thick packages or packages with complex folds sometimes spring open while being presented to the removal gripper arm.

OBJECTS

The present invention avoids these problems and has for one of its objects the provision of an improved transfer conveyor which is low cost and has increased productivity over existing transfer conveyors.

Another object of the present invention is the provision of an improved transfer conveyor which gives accurate presentation of a package to the removal gripper arm.

Another object of the present invention is the provision of an improved transfer conveyor which does not need additional power to provide the needed takeoff drive.

Another object of the present invention is the provision of an improved transfer conveyor in which the documents are securely transported without the need for additional hold down devices.

Another object of the present invention is the provision of an improved transfer conveyor in which an operator can easily remove a package therefrom if required.

Another object of the present invention is the provision of an improved transfer conveyor in which the operation thereof does not present a safety hazard.

Another object of the present invention is the provision of an improved transfer conveyor which will ensure repeatable positioning of the package in the transfer conveyor as it exits from the folding mechanism.

Another object of the present invention is the provision of an improved transfer conveyor which permits the packages to be precisely indexed down as it moves along.

Another object of the present invention is the provision of an improved transfer conveyor in which indexed stations may vary with package size.

Another object of the present invention is the provision of an improved transfer conveyor which will result in efficient and expeditious presentation of small packages without conveyor adjustments requirements.

Another object of the present invention is the provision of an improved transfer conveyor which prevents packages or complex folded packs from springing open while being moved along.

Other and further objects of the invention will be obvious upon an understanding of the illustrative embodiment about to be described, or will be indicated in the appended claims and various advantages not referred to herein will occur to one skilled in the art upon employment of the invention in practice.

The transfer conveyor of the present invention accomplishes these objects by using upper and lower flat belts to transport packages from the folding mechanism to a gripper arm station. At the gripper arm station the flat belts hold and precisely present the package to the gripper arm. The lightweight belts make it possible for commercially available power takeoffs to provide the needed drive without the need for auxiliary power supplies. The flat belts securely transport the documents without the need for additional hold down devices. Yet the operator can easily remove a package if it is required.

The flexible flat belts do not pose the hazards associated with indexing chains, thereby making the operation of the machine much safer for the operator. The flat belts provide secure repeatable positioning of the package in the transfer conveyor as it exits the folding mechanism. The repeatable positioning of packages at the infeed of the transfer conveyor permits the packages to be precisely indexed along the conveyor. Because there is no fitted divider between stations the number of indexed stations could vary with package size if it were desired. This gives quick efficient presentation of small packages, with no conveyor adjustments required. Variable precision indexing is provided by a clutch and brake which enables and inhibits movement of the flat belts in the transfer conveyor. Thick packages or complex folded packs (double parallel) will not spring open while being presented to the gripper arm. This is due to the package being captured by the belts at the top and at the bottom.

BRIEF DESCRIPTION OF THE DRAWINGS

A preferred embodiment of the invention has been chosen for purposes of illustration and description and is shown in the accompanying drawings forming a part of the specification, wherein.

DESCRIPTION

Figure 1:
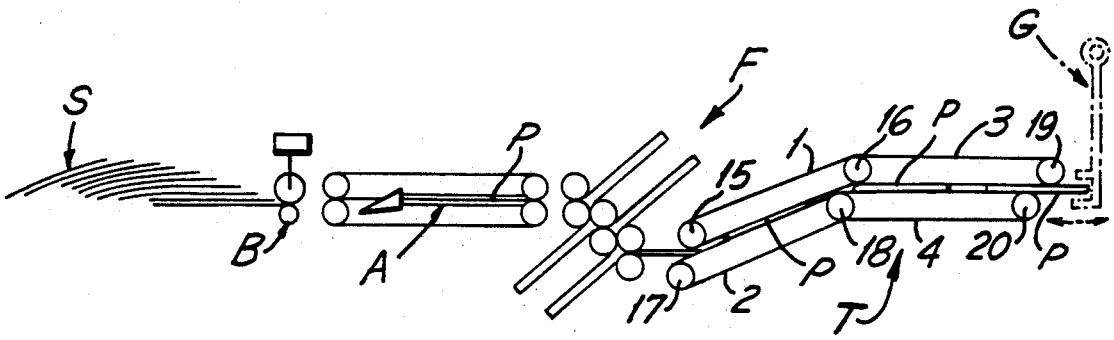
FIG. 1 is a diagrammatic view showing the operation of the present invention.
Figure 2:
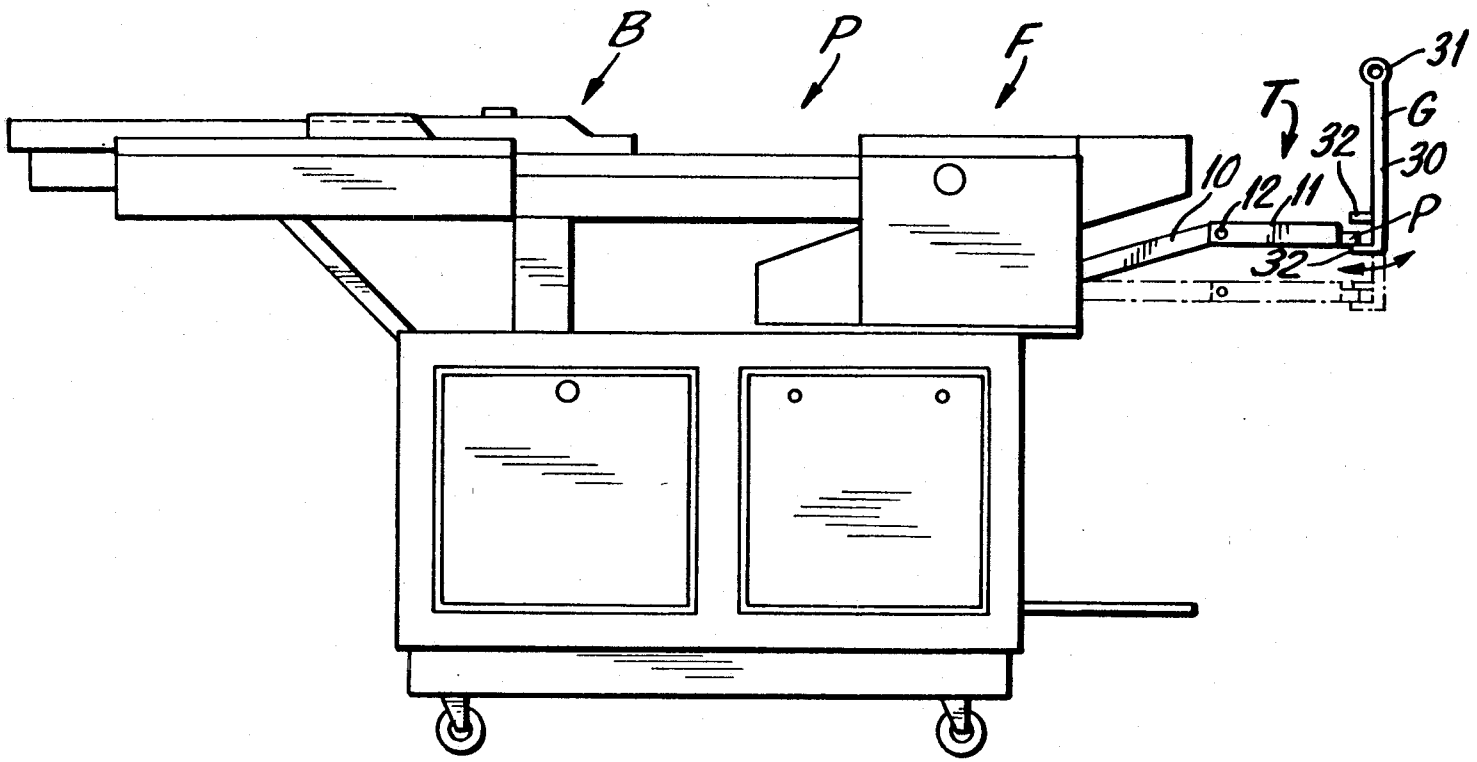
FIG. 2 is a side elevational view of the present invention.
Figure 5:
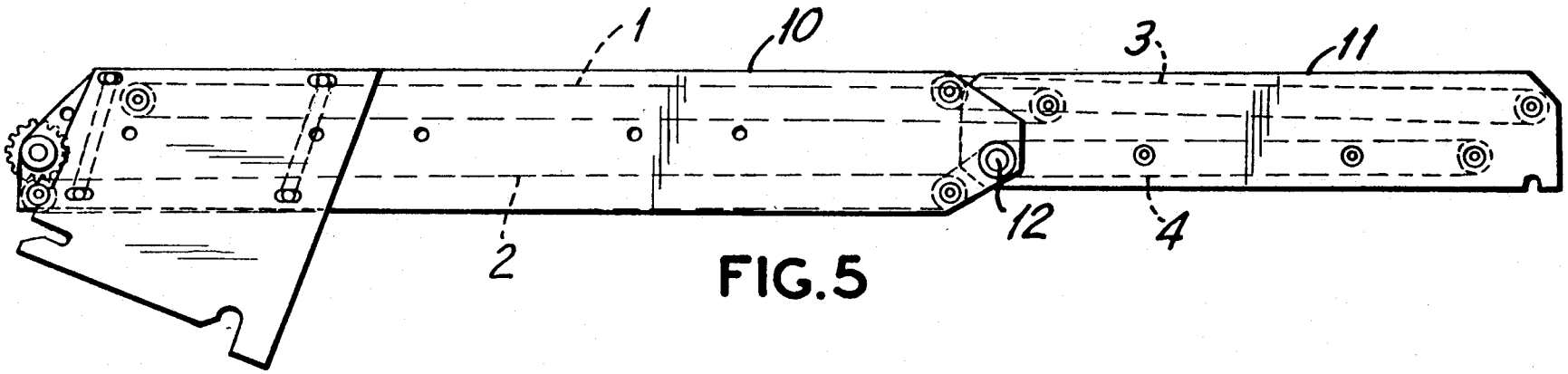
FIG. 5 is a side view showing the mechanism of the present invention in one position.
Figure 6:
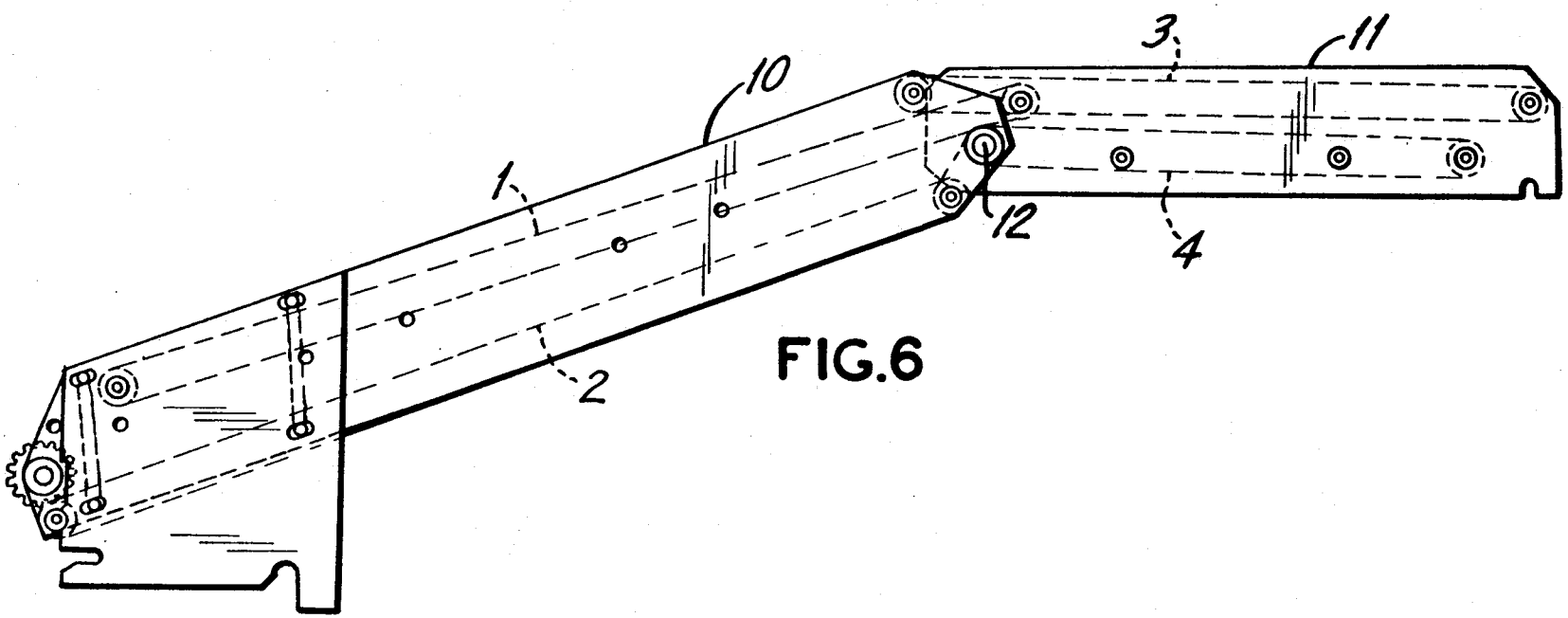
FIG. 6 is a side view showing the mechanism of the present invention in another position.

Referring to the drawings and more particularly to FIGS. 1 and 2, sheets of papers S are fed to and accumulated in an accumulating area A by a feeding or singulating mechanism B until a stack of sheets S of a predetermined height is reached. The stacks S are then moved to a folding mechanism F which folds and enfolds each stack S into a package P. From the folder F each package P is moved to a transfer conveyor assembly T. The transfer conveyor assembly T moves the package P until it reaches the end thereof where a gripper mechanism G will remove the package P from the transfer conveyor assembly T.

The transfer conveyor assembly T comprises a plurality of laterally spaced flat upper and lower endless belts 1-3 and 2-4, respectively. The packages P are moved from the folding mechanism F to a position between these endless belts 1-2. The endless belts 1-2 move the packages P along step-by-step until the packages P are transferred to a position between a second set of belts 3-4. They are moved by the belts 3-4 until they reach the end of the transfer conveyor assembly T where they are held until a gripper arm assembly G, or some other suitable removal mechanism, grips the package P and removes it from the transfer conveyor T.

Figure 4:
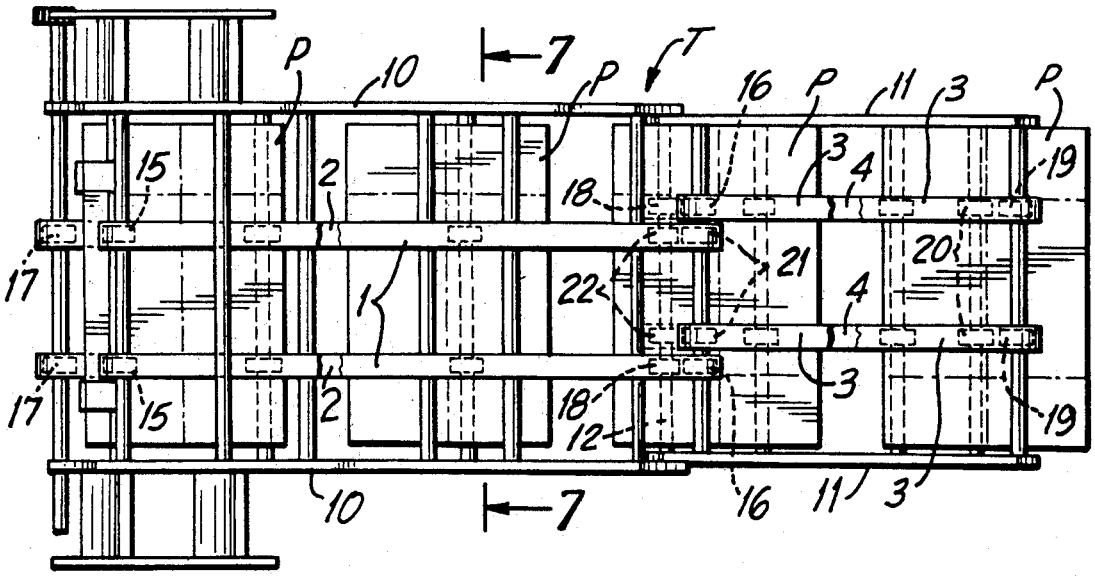
FIG. 4 is a top view thereof.
Figure 3:
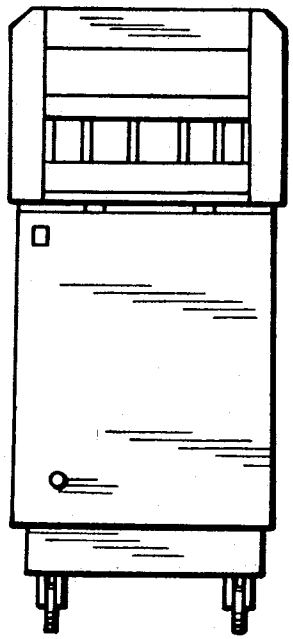
FIG. 3 is a front view thereof.

The transfer conveyor T comprises a pair of laterally spaced arms 10 and 11 extending from the folding mechanism F and foldable relative to the folding mechanism F and to each other along pivot 12. Between arms 10 and 11 are located the two pairs of upper and lower belts 1-2 and 3-4, respectively. The belts 1-2 between first arms 10 are offset laterally from the belts 3-4 between the second arm 11 (FIG. 4) so as not to interfere with each other's operation. The belts 1-2 and 3-4 are preferably in overlapping relationship to each other to permit the packages to be moved from belts 1-2 to belts 3-4. The belts 1-4 move the packages, preferably indexed in step-by-step fashion, from the point where the package P leaves the folding mechanism F to a point where the gripper arm G removes the package P from the transfer conveyor assembly T.

Figure 7:
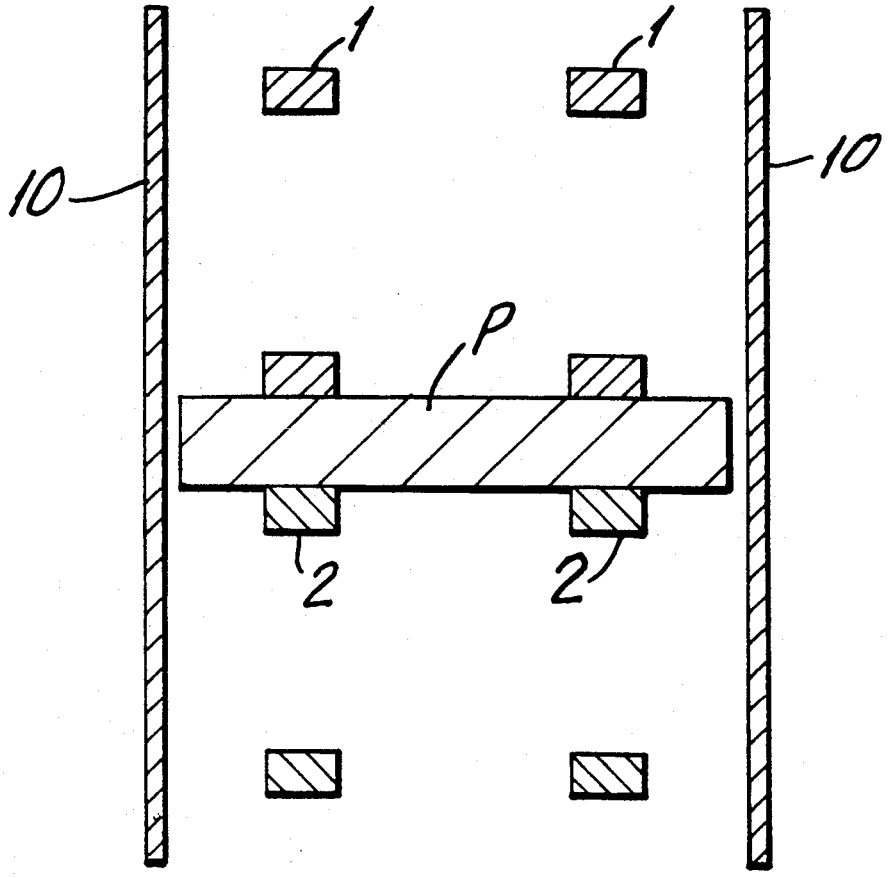
FIG. 7 is a diagrammatic sectional view taken along lines 7—7 of FIG. 4.

As shown in FIG. 7, the belts 1-4 have flat active faces so that the package P is securely held between the two belts. The belts 1-4 are adapted to be moved by rollers 15-22 which are journaled to the side arms 10-11. It will be noted that belt upper belts 1 and 3 are in advance of the lower belts 2 and 4. As shown in the drawings, upper belts 1 and 3 and lower belts 2 and 4 overlap each other so that when a package P is released by the first pair of belts 1-2, the package is already under the control of the second pair of belts 3-4. However, it is within the scope of the present invention for the upper belts 1-3 and lower belts 2-4 not to overlap each other.

The gripper G comprises an arm 30 which is pivoted at pivot 31 and has gripping jaws 32 facing the transfer assembly T. When the package P reaches the end of transfer assembly T, the gripper arm 30 swings around pivot 31 toward the package P and grips it. It will be understood that the gripper G may be swung into the proper position before the package reaches the end of transfer assembly T. When the arm 30 is pivoted back, it will remove the package P from the transfer assembly T. If the transfer assembly T is in its extended position, as indicated in broken lines in FIG. 2, the gripper G is extended by an conventional means to the proper position (as shown in broken lines) to be on the same level as the package P in order to be able to grip the package P and remove it from the transfer assembly T.

In operation, sheets S are fed to an accumulation area A. The accumulation area A will discharge an accumulated stack P on a command from a predetermined control system (not shown). The stack P then travels through a folding mechanism F which folds it into a package P. The package P exists the folding mechanism F in a precise position on the transfer conveyor assembly T between the upper and lower belts 1-2, i.e., between the lower run of belts 1 and the upper runs of belts 2. At the infeed to the transfer conveyor T a sensing mechanism (not shown) may be used to detect presence of the package P.

At this point, movement of the transfer conveyor assembly T is prevented by a brake (not shown—but may be any that is well known in the trade) to ensure precise positioning of the package P between belts 1-2. When a transfer conveyor assembly T is to be activated, the control system turns the brake off and activates a drive clutch (not shown—but may be any that is well known in the trade) so that the flat belts 1-2 of the transfer conveyor assembly T move in step-by-step fashion to move the package P forward.

As indicated above, the package P is picked up by the first pair of belts 1-2 and moved in step-by-step fashion between the two belts. The belts 1-2 hold the package securely in place. When the package reaches the end of the belts 1-2, the package P is then transferred to the second set of belts 3-4 which are shown as overlapping with the first set of belts 1-2 and are then moved along by the second set of belts 3-4 until they reach the end of the transfer assembly T where it is picked up by the gripper arm G.

The belts 1-2 are mounted on side arms 10 and belts 3-4 are mounted in side arms 11. The side arms 10 and 11 are pivoted relative to each other at point 12 so that the side arms 10 and 11 (together with their belts 1-4) may be adjusted downwardly and outwardly (broken lines in FIG. 2) or upwardly and inwardly (full lines in FIG. 2) relative to each other and to the folder F. The belts 1-4 are flat so that they will positively grip the top and bottom of a package P just being transported. As will be best seen from FIG. 4 the second set of belts 3-4 overlap the first set of belts 1-2 so that the package P can be transported from one set of belts to the other without interruption.

The length of each step that the belts are indexed can be determined by timing the clutch/brake activation or by some other means such as a tachometer feedback. This may be easily varied for different packages but permits the package P to be precisely positioned between the belts 1-2 and to be precisely positioned at the exit. At the discharge end of the transfer conveyor T a package P will be held in position between the upper and lower flat belts 3-4. The package P will wait there for the gripper arm G to remove the package P. By positioning a sensor mechanism (not shown) in this area, positioning and presence of a package P can be easily detected.

In transit, the package P may be easily removed and replaced by the operator without danger. The belts 1-4 hold the top and bottom of the package therebetween to prevent any package from springing open.

It will thus be seen that the present invention provided an improved transfer conveyor which is low cost, has increased productivity over existing transfer conveyors and which accurately presents a package to a removal gripper arm or some other suitable removal mechanism. The present invention also provides a transfer conveyor which does not need additional power to operate and in which documents are securely transported without the need for additional hold-down devices. The present invention also permits the operator to easily remove a package from the transfer assembly and can be safely operated. In addition, the present invention provides a transfer conveyor which ensures the repeatable positioning of a package in the transfer conveyor as it exits from the folding mechanism which permits the packages to be precisely indexed down as it moves along and in which indexed stations may vary with package size.

The improved transfer conveyor of the present invention will permit efficient and expeditious presentation of small packages without conveyor adjustments requirements and will prevent packages or complex folded packs from springing open while being moved along.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A transfer conveyor for conveying an article, said conveyor having an article-receiving end and an article-releasing end, comprising means for moving an article from the article-receiving end to the article-releasing end, means for supplying an article to said article-receiving end, means for removing the article from the article-releasing end, said moving means comprising a plurality of upper and lower belts, means for placing an article between said belts, means for moving the belts whereby an article is moved from the article-receiving end to the article-releasing end, the portions of the belts in contact with the package are flat, means for moving the belts in step-by-step fashion, said upper and lower belts comprise a first plurality of upper and lower belts and a second plurality of upper and lower belts, whereby the package is transferred from the said first plurality of belts to the second plurality of belts, each plurality of belts comprises a pair of upper belts and a pair of lower belts, said first plurality of belts and said second plurality of belts being angularly movable relative to each other.

2. A transfer conveyor as claimed in claim 1 wherein said article comprises a package.

3. A transfer conveyor as claimed in claim 2 wherein said article-removing means comprises means for gripping the package and removing it from the belts.

4. A transfer conveyor as claimed in claim 3 wherein the first plurality of belts and the second plurality of belts overlap each other.

5. A transfer conveyor for conveying an article, said conveyor having an article-receiving end and an article-releasing end, comprising means for moving an article from the article-receiving end to the article-releasing end, means for supplying an article to said article-receiving end, means for removing the article from the article-releasing end, said moving means comprising a plurality of belts, means for placing an article between said belts, means for moving the belts whereby an article is moved from the article-receiving end to the article-releasing end, said article comprising a package, said article-removing means comprising means for gripping the package and removing it from the belts, said belts comprising a plurality of upper and lower belts between which the package is placed, the portions of the belts in contact with the package being flat, means are provided to move the belts in step-by-step fashion, said upper and lower belts comprise a first plurality of upper and lower belts and a second plurality of upper and lower belts and wherein the package is transferred from the said first plurality of belts to the second plurality of belts, each plurality of belts comprising a pair of upper belts and a pair of lower belts, said first plurality of belts and the second plurality of belts overlap each other, the first plurality of belts and the second plurality of belts are pivotally movable relative to each other whereby the transfer conveyor can be raised or lowered to different levels and moved toward or away from the package removing means.

6. A transfer conveyor as claimed in claim 5 wherein in each of said first and second plurality of belts the upper pair of belts are offset from the lower pair of belts.

7. A transfer conveyor as claimed in claim 6 wherein means are provided to accumulate sheets in a stack and means are provided for moving said stack to a folding mechanism to cause the sheets to be folded by the folding mechanism to form the package.

8. A transfer conveyor as claimed in claim 7 wherein said package removing means is a pivoted gripper arm having package-gripping means.

* * * * *